US011363924B1

(12) United States Patent
Campo et al.

(10) Patent No.: US 11,363,924 B1
(45) Date of Patent: Jun. 21, 2022

(54) CEILING FAN BLADE CLEANING VACUUM ATTACHMENT

(71) Applicants: Richard Campo, Centereach, NY (US); Joseph Nicholson, Centereach, NY (US)

(72) Inventors: Richard Campo, Centereach, NY (US); Joseph Nicholson, Centereach, NY (US)

( * ) Notice: Subject to any disclaimer, the term of this patent is extended or adjusted under 35 U.S.C. 154(b) by 350 days.

(21) Appl. No.: 16/666,538

(22) Filed: Oct. 29, 2019

(51) Int. Cl.
*A47L 9/06* (2006.01)
*A47L 9/24* (2006.01)
*A47L 7/00* (2006.01)

(52) U.S. Cl.
CPC ..... *A47L 9/0693* (2013.01); *A47L 7/009* (2013.01); *A47L 9/0606* (2013.01); *A47L 9/242* (2013.01)

(58) Field of Classification Search
CPC ..... A47L 9/0696; A47L 7/009; A47L 9/0606; A47L 9/242
USPC ..... 15/394, 321, 344, 24
See application file for complete search history.

(56) References Cited

U.S. PATENT DOCUMENTS 2,246,036 A * 6/1941 Farrell ..... A47L 4/02 15/387
3,892,004 A * 7/1975 Downes ..... A47L 4/02 15/102
5,235,722 A 8/1993 Harris
D341,452 S 11/1993 Songer
5,313,687 A 5/1994 Schneider
5,400,468 A * 3/1995 De Petra ..... A46B 13/04 15/394
D395,102 S 6/1998 Cika
5,765,259 A 6/1998 Cika
6,345,409 B1 2/2002 LaCroix
7,363,674 B2 4/2008 Marshall
8,734,585 B1 * 5/2014 Muncy ..... A47L 4/00 134/6
9,402,519 B2 * 8/2016 Andrikanich ..... A47L 9/0693

FOREIGN PATENT DOCUMENTS

CA 2365574 7/2002

* cited by examiner

*Primary Examiner* — Joseph J Hail
*Assistant Examiner* — Shantese L McDonald

(57) ABSTRACT

The ceiling fan blade cleaning vacuum attachment may comprise a housing, an upper brush, a lower brush, and a pneumatic brush motor. The ceiling fan blade cleaning vacuum attachment may clean an individual blade selected from a plurality of blades of a ceiling fan. A vacuum hose coupled to a vacuum cleaner may be separably couple to a neck of the housing. The individual blade may be inserted into a blade slot of the housing. Suction generated by the vacuum cleaner may draw air through the blade slot and through the neck of the housing. The air may turn a turbine rotor of the pneumatic brush motor, which may drive the upper brush and the lower brush 256 to sweep the individual blade.

17 Claims, 6 Drawing Sheets

CEILING FAN BLADE CLEANING VACUUM ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of vacuum cleaner attachments and ceiling fan blade cleaning tools, more specifically, a ceiling fan blade cleaning vacuum attachment.

SUMMARY OF INVENTION

The ceiling fan blade cleaning vacuum attachment may comprise a housing, an upper brush, a lower brush, and a pneumatic brush motor. The ceiling fan blade cleaning vacuum attachment may clean an individual blade selected from a plurality of blades of a ceiling fan. A vacuum hose coupled to a vacuum cleaner may be separably couple to a neck of the housing. The individual blade may be inserted into a blade slot of the housing. Suction generated by the vacuum cleaner may draw air through the blade slot and through the neck of the housing. The air may turn a turbine rotor of the pneumatic brush motor, which may drive the upper brush and the lower brush to sweep the individual blade.

An object of the invention is to clean a blade of a ceiling fan.

Another object of the invention is to provide a rotating upper brush and a rotating lower brush on opposites sides of the fan blade.

A further object of the invention is to drive the rotation of the upper brush and the lower brush using a pneumatic brush motor disposed in the neck of the housing and driven by the air drawn into the vacuum cleaner.

Yet another object of the invention is to provide a brush slot within the brush cover and a hanging latch dog to allow the fan blade to be inserted into the brush slot and to prevent the fan blade from exiting the brush slot at the distal end of the brush slot.

These together with additional objects, features and advantages of the ceiling fan blade cleaning vacuum attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the ceiling fan blade cleaning vacuum attachment in detail, it is to be understood that the ceiling fan blade cleaning vacuum attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ceiling fan blade cleaning vacuum attachment.

It is therefore important that the claims be regarded as including such equivalent construction insofar as they do not depart from the spirit and scope of the ceiling fan blade cleaning vacuum attachment. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
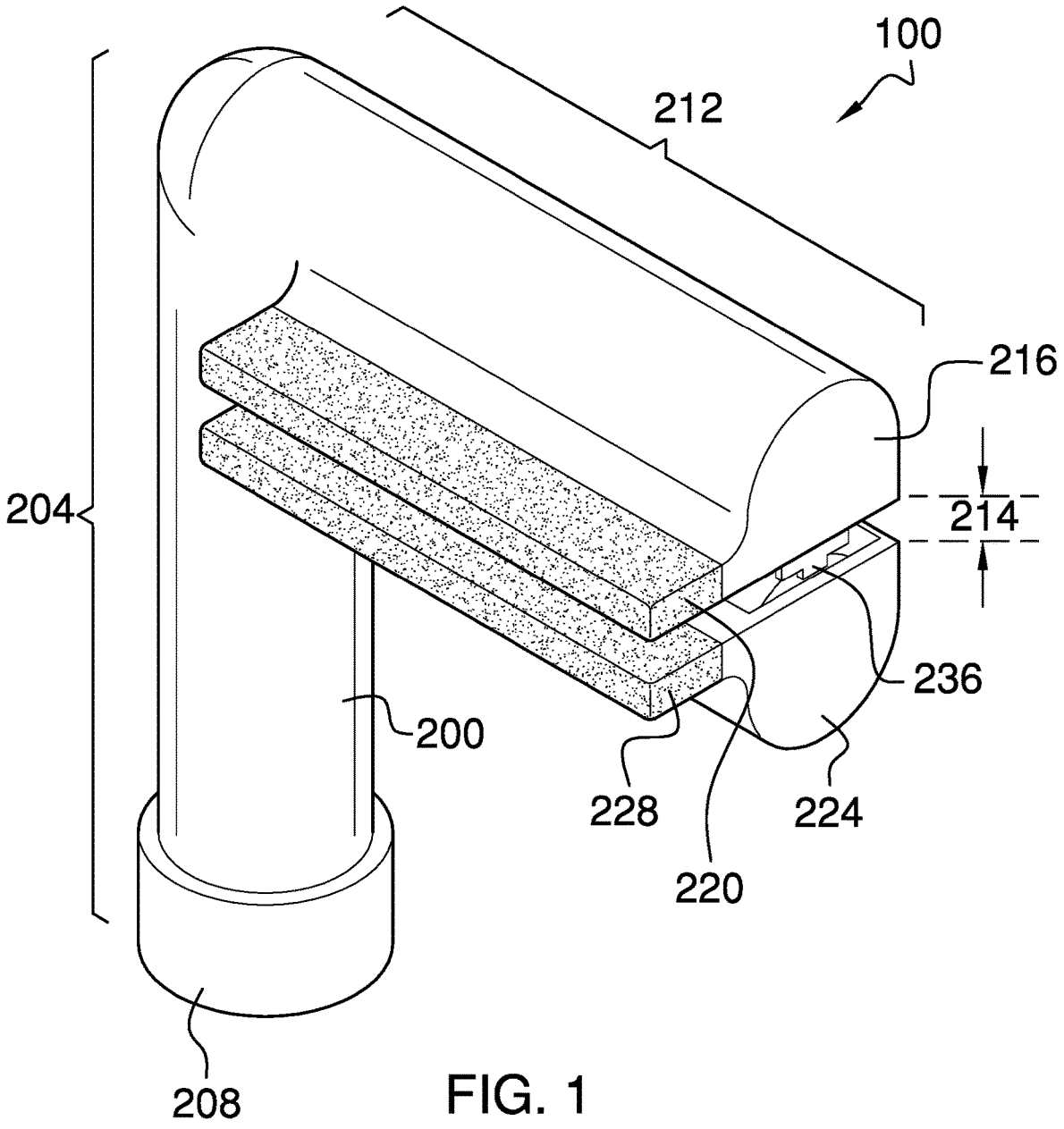
FIG. 1 is an isometric view of an embodiment of the disclosure.
Figure 2:
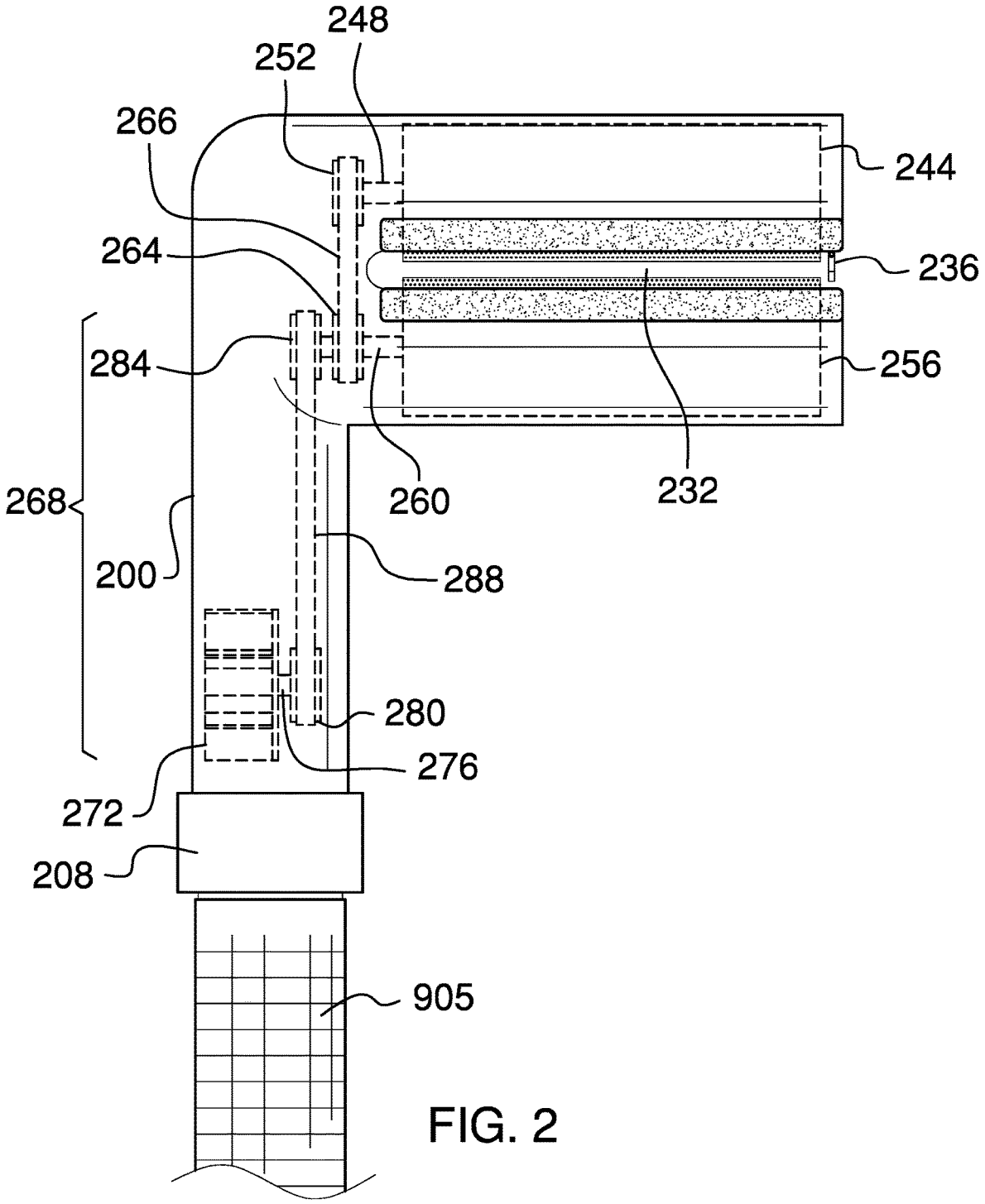
FIG. 2 is a side view of an embodiment of the disclosure.
Figure 3:
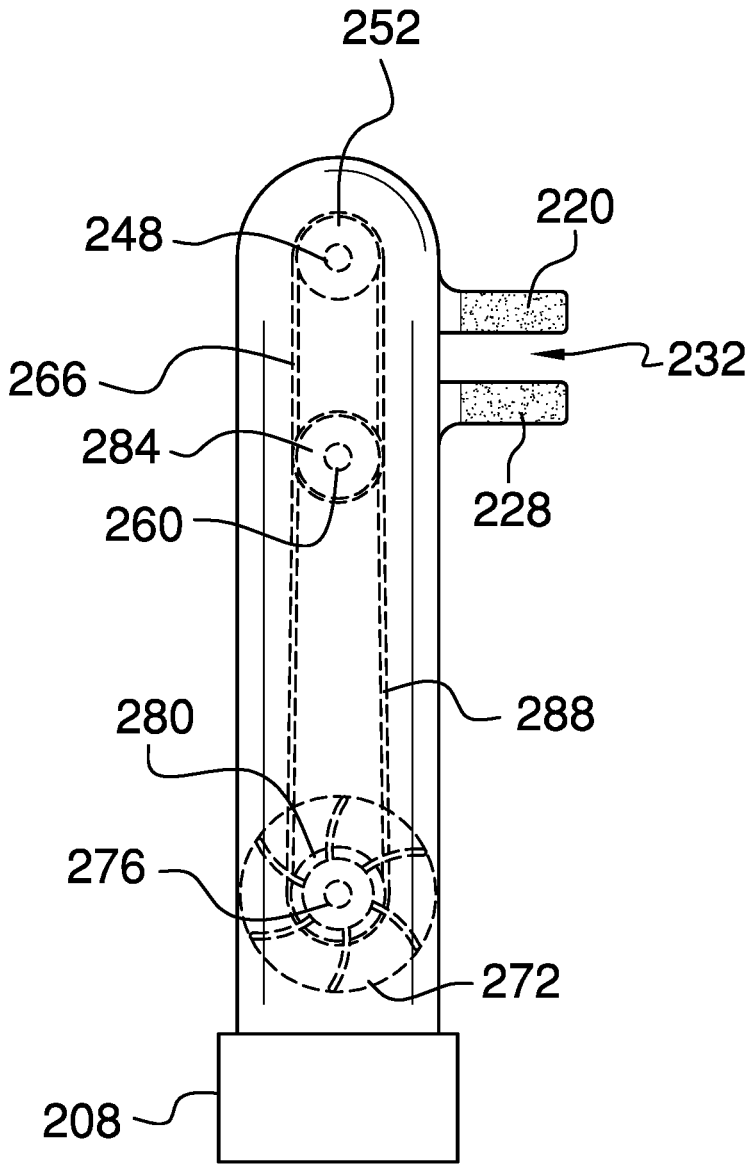
FIG. 3 is a back view of an embodiment of the disclosure.
Figure 4:
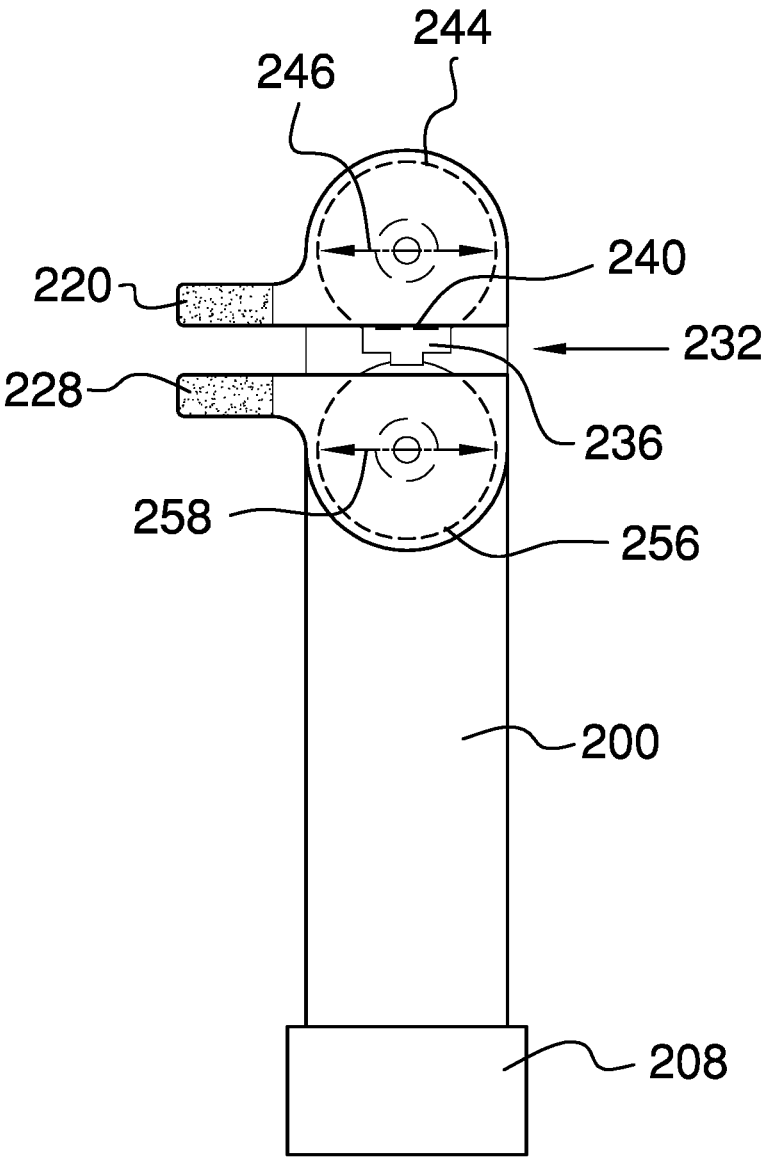
FIG. 4 is a front view of an embodiment of the disclosure.
Figure 5:
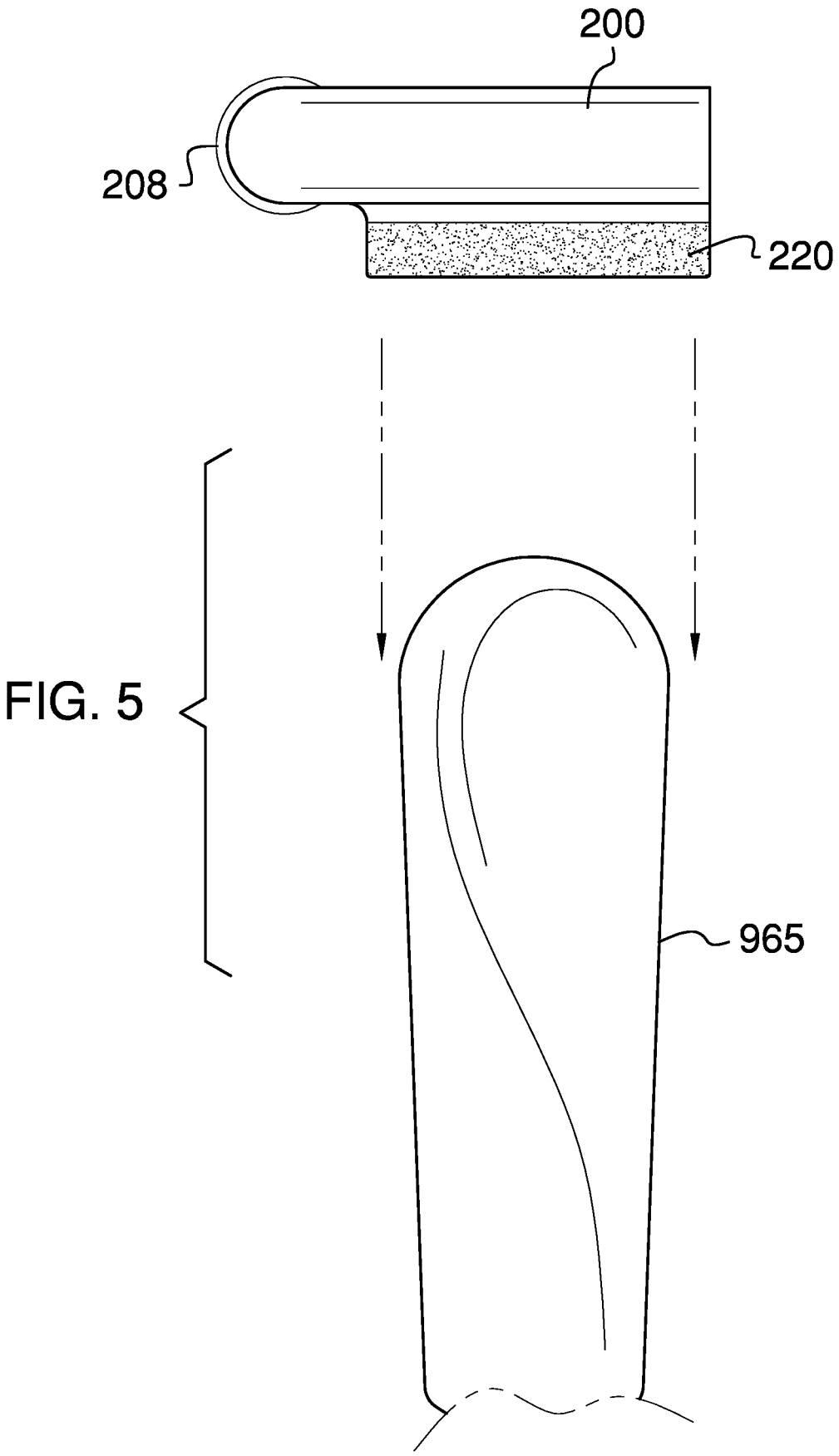
FIG. 5 is a top in-use view of an embodiment of the disclosure across 5-5 as shown in FIG. 2.
Figure 6:
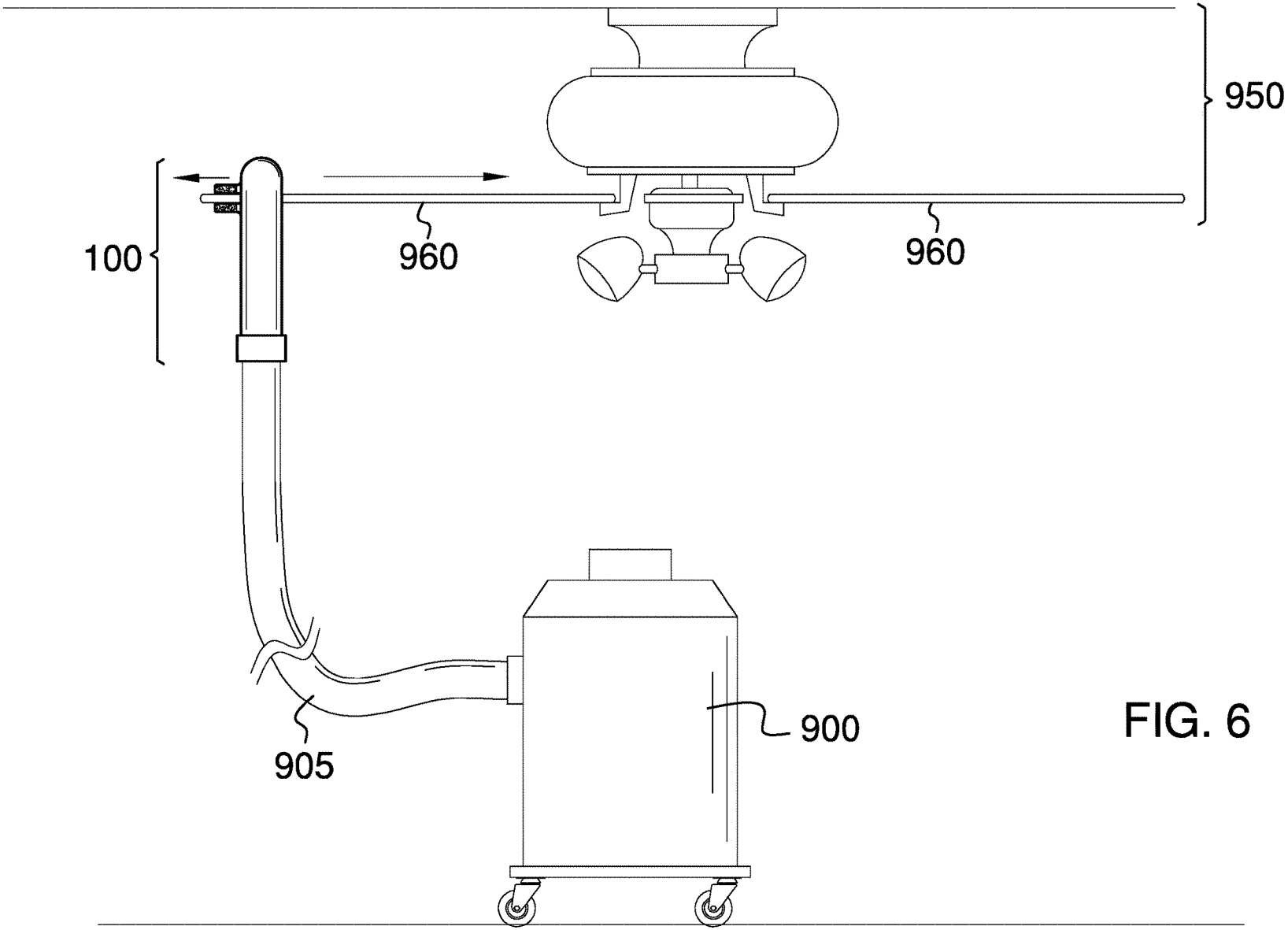
FIG. 6 is an in-use view of an embodiment of the disclosure.

Detailed reference will now be made to a first potential embodiment of the disclosure, which is illustrated in FIGS. 1 through 6.

The ceiling fan blade cleaning vacuum attachment 100 (hereinafter invention) comprises a housing 200, an upper brush 244, a lower brush 256, and a pneumatic brush motor 268. The invention 100 may clean an individual blade 965 selected from a plurality of blades 960 of a ceiling fan 950. A vacuum hose 905 coupled to a vacuum cleaner 900 may be separably coupled to a neck 204 of the housing 200. The individual blade 965 may be inserted into a blade slot 232 of the housing 200. Suction generated by the vacuum cleaner 900 may draw air through the blade slot 232 and through the neck 204 of the housing 200. The air may turn a turbine rotor 272 of the pneumatic brush motor 268 which may drive the upper brush 244 and the lower brush 256 to sweep the individual blade 965.

The housing 200 may comprise the neck 204 and a brush cover 212. The housing 200 may be an L-shaped enclosure for the upper brush 244, the lower brush 256, and the pneumatic brush motor 268. The neck 204 may comprise a hose coupler 208. The neck 204 may be the vertical portion of the housing. The neck 204 may house the turbine rotor 272. The neck 204 may direct the air past the turbine rotor 272. The bottom of the neck 204 may couple to the vacuum hose 905 via the hose coupler 208. The top of the neck 204 may couple to the brush cover 212.

The brush cover 212 may comprise an upper brush cover 216, a lower brush cover 224, and the blade slot 232. The brush cover 212 may be the horizontal portion of the housing. The upper brush cover 216 may be located above the lower brush cover 224 and may be oriented to be parallel to the lower brush cover 224. The blade slot 232 may be a gap between the upper brush cover 216 and the lower brush cover 224. A height 214 of the blade slot 232 may be larger than the thickness of the individual blade 965.

The upper brush cover 216 may be an enclosure for the upper brush 244. The upper brush cover 216 may be open on the bottom such that the upper brush 244 may contact the individual blade 965 as the individual blade 965 passes through the blade slot 232. The upper brush cover 216 may comprise an upper wiping strip 220. The upper wiping strip 220 may project from the upper brush cover 216 in a direction that is orthogonal to both the neck 204 and the upper brush cover 216.

The lower brush cover 224 may be an enclosure for the lower brush 256. The lower brush cover 224 may be open on the top such that the lower brush 256 may contact the individual blade 965 as the individual blade 965 passes through the blade slot 232. The lower brush cover 224 may comprise a lower wiping strip 228. The lower wiping strip 228 may project from the lower brush cover 224 in a direction that is orthogonal to both the neck 204 and the lower brush cover 224. The upper wiping strip 220 may be located above the lower wiping strip 228 such that as the individual blade 965 passes through the blade slot 232, the top surface of the individual blade 965 is wiped by the upper wiping strip 220 and the bottom surface of the individual blade 965 is wiped by the upper wiping strip 220. In some embodiments, the upper wiping strip 220 and the lower wiping strip 228 may be microfiber strips.

A hanging latch dog 236 may be pivotably coupled to the distal end of the upper brush cover 216 such that the hanging latch dog 236 hangs down into the blade slot 232. In this context, distal refers to the end of the housing 200 that is farthest away from the vacuum cleaner 900. A hinge 240 may permit the hanging latch dog 236 to pivot from a vertical orientation to a horizontal orientation when the individual blade 965 presses against the hanging latch dog 236 from outside of the housing 200. The hanging latch dog 236 may pivot from the horizontal orientation to the vertical orientation once the individual blade 965 is within the blade slot 232. The hinge 240 may prevent the hanging latch dog 236 from hinging from a vertical orientation if the individual blade 965 presses against the hanging latch dog 236 from within the blade slot 232 such the individual blade 965 may only exit the blade slot 232 by being pulled through the blade slot 232 in the longitudinal direction of the individual blade 965.

The upper brush 244 may be a cylindrical brush. The upper brush 244 may rotate around an upper brush axle 248 when activated. The upper brush axle 248 may be oriented horizontally and may be supported by the upper brush cover 216. An upper brush diameter 246 may be such that the upper brush 244 extends into the blade slot 232 and fits within the upper brush cover 216. An upper brush pulley 252 may be coupled to the proximal end of the upper brush axle 248. In this context, proximal refers to the end of the upper brush axle 248 that is closest to the vacuum cleaner 900.

The lower brush 256 may be a cylindrical brush. The lower brush 256 may rotate around a lower brush axle 260 when activated. The lower brush axle 260 may be oriented horizontally and may be supported by the lower brush cover 224. A lower brush diameter 258 may be such that the lower brush 256 extends into the blade slot 232 and fits within the lower brush cover 224. A lower brush pulley 264 may be coupled to the proximal end of the lower brush axle 260. In this context, proximal refers to the end of the lower brush axle 260 that is closest to the vacuum cleaner 900.

The upper brush pulley 252 and the lower brush pulley 264 may be vertically aligned. A brush belt 266 may couple the upper brush pulley 252 to the lower brush pulley 264 such that rotation of the lower brush 256 causes rotation of the upper brush 244.

An upper turbine pulley 284 may be coupled to the lower brush axle 260 in a position that is parallel to the lower brush pulley 264. The upper brush 244 and the lower brush 256 may be activated by rotating the upper turbine pulley 284.

The pneumatic brush motor 268 may comprise the turbine rotor 272, a turbine axle 276, a lower turbine pulley 280, the upper turbine pulley 284, and a turbine belt 288. The pneumatic brush motor 268 may convert the passage of the air through the neck 204 into rotation of the upper brush 244 and the lower brush 256.

The turbine rotor 272 may be coupled to the turbine axle 276. The turbine axle 276 may be rotationally coupled to the housing 200 within the lower half of the neck 204 such that the turbine rotor 272 is placed into the air flow through the neck 204.

The lower turbine pulley 280 may be coupled to the turbine axle 276 such that rotation of the turbine rotor 272 causes rotation of the lower turbine pulley 280. The lower turbine pulley 280 and the upper turbine pulley 284 may be vertically aligned.

The turbine belt 288 may couple the upper turbine pulley 284 to the lower turbine pulley 280 such that rotation of the lower turbine pulley 280 causes rotation of the upper turbine pulley 284.

Those skilled in the art will recognize that other mechanical components may be used to drive the upper brush 244 and the lower brush 256. As non-limiting examples, the lower turbine pulley 280, the upper turbine pulley 284, the lower brush pulley 264, the upper brush pulley 252, or combinations thereof may be gears instead of pulleys and the turbine belt 288, the brush belt 266, or combinations thereof may be chains instead of belts.

In use, the neck 204 may be coupled to the vacuum hose 905 of the vacuum cleaner 900 and the vacuum cleaner 900 may be turned on. Air entering the blade slot 232 may pass through the neck 204 and may cause rotation of the turbine rotor 272. Rotation of the turbine rotor 272 may cause rotation of the turbine axle 276 and the lower turbine pulley 280. The turbine belt 288 may transfer rotation of the lower turbine pulley 280 to the upper turbine pulley 284, thus causing the lower brush 256 to rotate. The lower brush pulley 264 and the brush belt 266 may transfer rotation of the lower brush 256 to the upper brush 244, thus causing the upper brush 244 to rotate.

The brush cover 212 may be placed over the individual blade 965 selected from the plurality of blades 960 of the ceiling fan by placing the end of the individual blade 965 closest to the center of the ceiling fan 950 into the blade slot 232 via the hanging latch dog 236. The brush cover 212 may be moved along the longitudinal direction of the individual blade 965 until the individual blade 965 exits from the blade slot 232. As the brush cover 212 passes over the individual blade 965, the upper wiping strip 220 and the lower wiping strip 228 may wipe the individual blade 965 and the upper brush 244 and the lower brush 256 sweep the individual blade 965.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "axle" is a cylindrical shaft that is inserted through the center of an object such that the center axis of the object and the center axis of the axle are aligned and the object can rotate using the axle as an axis of rotation.

As used in this disclosure, a "brush" is a device comprising a plurality of bristles set into a handle or a base that is used for grooming, sweeping, smoothing, scrubbing, cleaning, or painting.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the terms "distal" and "proximal" may be used to describe relative positions. Distal refers to the object, or the end of an object, that is situated away from the point of origin, point of reference, or point of attachment. Proximal refers to the object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used herein, a "dog" is a mechanical part that prevents movement or imparts movement by offering physical obstruction or engagement of some kind. The dog may hold another object in place by blocking the object, clamping the object, or otherwise obstructing movement of the object. Alternatively, the dog may couple various parts together so that they move in unison. In some embodiments, dog clutches may lock two spinning components together.

As used in this disclosure, a "fan" is a mechanical device with rotating blades that is used to create a flow or current of air.

As used in this disclosure, a "hinge" is a device that permits the turning, rotating, or pivoting of a first object relative to a second object.

As used in this disclosure, "horizontal" is a directional term that refers to a direction that is perpendicular to the local force of gravity. Unless specifically noted in this disclosure, the horizontal direction is always perpendicular to the vertical direction.

As used herein, the word "hose" is intended to include hoses, tubing, piping, and other conduits capable of directing a flow of a gas or a liquid. When referring to a hose in this disclosure, the terms inner diameter and outer diameter are used as they would be used by those skilled in the plumbing arts.

As used in this disclosure, a "housing" is a rigid casing that encloses and protects one or more devices.

As used in this disclosure, a "latch" is a fastening or locking mechanism. The use of the term latch may imply the insertion of an object into a notch or cavity. The act of latching may involve a linear, pivoting, or rotating motion.

As used herein, the word "longitudinal" or "longitudinally" refers to a lengthwise or longest direction.

As used in this disclosure, "orientation" refers to the positioning and/or angular alignment of a first object relative to a second object or relative to a reference position or reference direction.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure a "pulley" is a wheel with a grooved rim around which a cord (or other form of rope, line, belt, or cable) passes. The pulley may be used to change the direction of a force applied to the cord. In some embodiments, pulleys may be used in groups of two or more to convey a force from one pulley to all other pulleys in the group via a belt.

As used in this disclosure, "rotor" may refer to the bladed rotating part of a turbine or to the rotating part of an electric motor, electric generator, or an alternator.

In this disclosure, a "turbine" converts the kinetic energy of a moving fluid or gas to rotational energy. In common usage, a turbine generally accomplishes this by forcing the moving fluid or gas through a series of blades arrayed around the circumference of a wheel, rotor, or cylinder. Alternative, a turbine can run in a reverse mode wherein externally provided rotational energy will be converted into kinetic energy that is expressed as the movement or compression of a fluid or gas.

As used herein, "vacuum cleaner" refers to a device that uses suction to collect dust and small particles from a floor or other surface. In some embodiments, a vacuum cleaner may provide a hose and one or more hose attachments to contact the surface that is being vacuumed.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS.

1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ceiling fan blade cleaning vacuum attachment comprising:

a housing, an upper brush, a lower brush, and a pneumatic brush motor;

wherein the ceiling fan blade cleaning vacuum attachment cleans an individual blade selected from a plurality of blades of a ceiling fan;

wherein a vacuum hose coupled to a vacuum cleaner is separably coupled to a neck of the housing;

wherein the individual blade is inserted into a blade slot of the housing;

wherein suction generated by the vacuum cleaner draws air through the blade slot and through the neck of the housing;

wherein the air turns a turbine rotor of the pneumatic brush motor thus driving the upper brush and the lower brush to sweep the individual blade;

wherein the housing comprises the neck and a brush cover;

wherein the housing is an L-shaped enclosure for the upper brush, the lower brush, and the pneumatic brush motor;

wherein the brush cover comprises an upper brush cover, a lower brush cover, and the blade slot;

wherein the upper brush cover is an enclosure for the upper brush;

wherein the upper brush cover is open on a bottom such that the upper brush contacts the individual blade as the individual blade passes through the blade slot;

wherein the upper brush cover comprises an upper wiping strip;

wherein the upper wiping strip projects from the upper brush cover in a direction that is orthogonal to both the neck and the upper brush cover.

2. The ceiling fan blade cleaning vacuum attachment according to claim 1 wherein the neck comprises a hose coupler;

wherein the neck is the vertical portion of the housing;

wherein the neck houses the turbine rotor;

wherein the neck directs the air past the turbine rotor;

wherein the bottom of the neck couples to the vacuum hose via the hose coupler;

wherein the top of the neck couples to the brush cover.

3. The ceiling fan blade cleaning vacuum attachment according to claim 2 wherein the brush cover is the horizontal portion of the housing;

wherein the upper brush cover is located above the lower brush cover and are oriented to be parallel to the lower brush cover.

4. The ceiling fan blade cleaning vacuum attachment according to claim 3 wherein the blade slot is a gap between the upper brush cover and the lower brush cover;

wherein a height of the blade slot is larger than the thickness of the individual blade.

5. The ceiling fan blade cleaning vacuum attachment according to claim 4 wherein the lower brush cover is an enclosure for the lower brush;

wherein the lower brush cover is open on the top such that the lower brush contacts the individual blade as the individual blade passes through the blade slot;

wherein the lower brush cover comprises a lower wiping strip;

wherein the lower wiping strip projects from the lower brush cover in a direction that is orthogonal to both the neck and the lower brush cover.

6. The ceiling fan blade cleaning vacuum attachment according to claim 5 wherein the upper wiping strip is located above the lower wiping strip such that as the individual blade passes through the blade slot, the top surface of the individual blade is wiped by the upper wiping strip and the bottom surface of the individual blade is wiped by the upper wiping strip.

7. The ceiling fan blade cleaning vacuum attachment according to claim 6 wherein the upper wiping strip and the lower wiping strip are microfiber strips.

8. The ceiling fan blade cleaning vacuum attachment according to claim 6 wherein a hanging latch dog is pivotably coupled to the distal end of the upper brush cover such that the hanging latch dog hangs down into the blade slot.

9. The ceiling fan blade cleaning vacuum attachment according to claim 8 wherein a hinge permits the hanging latch dog to pivot from a vertical orientation to a horizontal orientation when the individual blade presses against the hanging latch dog from outside of the housing;

wherein the hanging latch dog pivots from the horizontal orientation to the vertical orientation once the individual blade is within the blade slot;

wherein the hinge prevents the hanging latch dog from hinging from a vertical orientation if the individual blade presses against the hanging latch dog from within the blade slot such the individual blade only exits the blade slot by being pulled through the blade slot in the longitudinal direction of the individual blade.

10. The ceiling fan blade cleaning vacuum attachment according to claim 9 wherein the upper brush is a cylindrical brush;

wherein the upper brush rotates around an upper brush axle when activated;

wherein the upper brush axle is oriented horizontally and is supported by the upper brush cover;

wherein an upper brush diameter is such that the upper brush extends into the blade slot and fits within the upper brush cover;

wherein an upper brush pulley is coupled to the proximal end of the upper brush axle.

11. The ceiling fan blade cleaning vacuum attachment according to claim 10 wherein the lower brush is a cylindrical brush;

wherein the lower brush rotates around a lower brush axle when activated;

wherein the lower brush axle is oriented horizontally and is supported by the lower brush cover;

wherein a lower brush diameter is such that the lower brush extends into the blade slot and fits within the lower brush cover;

wherein a lower brush pulley is coupled to the proximal end of the lower brush axle.

12. The ceiling fan blade cleaning vacuum attachment according to claim 11 wherein the upper brush pulley and the lower brush pulley are vertically aligned;

wherein a brush belt couples the upper brush pulley to the lower brush pulley such that rotation of the lower brush causes rotation of the upper brush.

13. The ceiling fan blade cleaning vacuum attachment according to claim 12 wherein an upper turbine pulley is coupled to the lower brush axle in a position that is parallel to the lower brush pulley;

wherein the upper brush and the lower brush are activated by rotating the upper turbine pulley.

14. The ceiling fan blade cleaning vacuum attachment according to claim 13 wherein the pneumatic brush motor comprises the turbine rotor, a turbine axle, a lower turbine pulley, the upper turbine pulley, and a turbine belt;

wherein the pneumatic brush motor converts the passage of the air through the neck into rotation of the upper brush and the lower brush.

15. The ceiling fan blade cleaning vacuum attachment according to claim 14 wherein the turbine rotor is coupled to the turbine axle;

wherein the turbine axle is rotationally coupled to the housing within the lower half of the neck such that the turbine rotor is placed into the air flow through the neck.

16. The ceiling fan blade cleaning vacuum attachment according to claim 15 wherein the lower turbine pulley is coupled to the turbine axle such that rotation of the turbine rotor causes rotation of the lower turbine pulley;

wherein the lower turbine pulley and the upper turbine pulley are vertically aligned.

17. The ceiling fan blade cleaning vacuum attachment according to claim 16 wherein the turbine belt couples the upper turbine pulley to the lower turbine pulley such that rotation of the lower turbine pulley causes rotation of the upper turbine pulley.

* * * * *